United States Patent [19]

Stewart

[11] Patent Number: 4,962,913

[45] Date of Patent: Oct. 16, 1990

[54] SIDEWALK LIFTER

[76] Inventor: John V. Stewart, 1308 Henry Balch Dr., Orlando, Fla. 32810

[21] Appl. No.: 261,606

[22] Filed: Oct. 24, 1988

[51] Int. Cl.[5] ..... B66D 1/00

[52] U.S. Cl. ..... 254/269; 254/4 R; 254/324

[58] Field of Search ..... 254/2 RBC, 4 RBC, 133 R, 254/269, 270, 324, 326, 327, 336

[56] References Cited

U.S. PATENT DOCUMENTS

| | | | |
|---|---|---|---|
| 1,745,046 | 1/1930 | Romine | 254/324 |
| 3,945,612 | 3/1976 | Motoda | 254/269 |
| 4,491,452 | 1/1985 | Matovich | 254/4 R |

FOREIGN PATENT DOCUMENTS

| | | | |
|---|---|---|---|
| 175198 | 2/1922 | United Kingdom | 254/4 R |

*Primary Examiner*—J. J. Hartman

[57] ABSTRACT

A device is disclosed for realignment of sidewalk sections displaced by settling or root lifting, where a hazardous step exists at a joint or crack. It comprises a rigid longitudinal span supported over the section, with cross members reaching over the section sides. Hooks are suspended from the ends of the cross members, and hooked under the section sides. Winches on the cross members raise the hooks, lifting the section. Dirt is added under the section and graded with a long-handled spreader to realign the section effectively and inexpensively.

This method of repair is much better than repouring or patching. Repouring is expensive, and makes the adjacent sections look old by comparison. Patching produces a short ramp, which is itself a hazard and has a makeshift appearance.

The device is light enough to be manually positioned with attached wheels, stable in operation, and inexpensive. The only repair material used is dirt, making repairs very inexpensive.

10 Claims, 3 Drawing Sheets

SIDEWALK LIFTER

BACKGROUND—FIELD OF INVENTION

Figure 1:
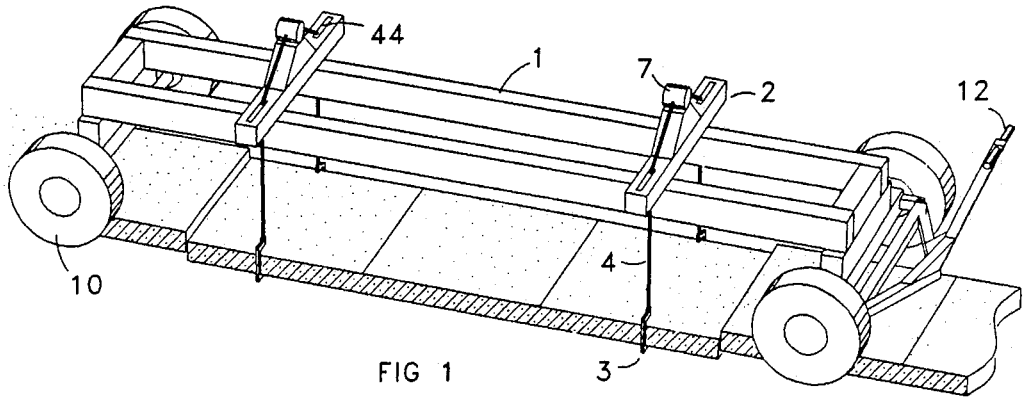

This invention relates to maintenance and repair of concrete sidewalks, and to a previous patent application by this inventor of 9/16/88, No. 245230. The device described in that application will be called Walklift-1 here, and the current invention Walklift-2.

BACKGROUND—PRIOR ART

Sidewalks lose their alignment over time, due to settling and tree root lifting. This causes steps to form at joints and cracks, which are hazards to sidewalk users and liabilities to those responsible for maintenance. Current repair options include:

1. Build a ramp of concrete or asphalt from the lower section to the upper one, filling the step. This short ramp is itself a hazard, and has a makeshift, patched appearance. Adhesion of concrete and asphalt to old concrete is poor, so the repair soon degrades.

2. Remove and repour the sunken section. This is expensive and results in a mismatched appearance due to the age difference between sections. If heavy equipment is used to demolish and remove concrete, it can cause damage to landscaping, driveways, curbs, and other structures.

3. A previous patent application of this inventor, for the device called Walklift-1, describes a better technique, which is useful in many cases. It provides a practical, inexpensive device for lifting one end of a sunken section, so that dirt can be added underneath to restore alignment. The current invention lifts the whole section rather than just one end.

OBJECTS AND ADVANTAGES

The objective of this invention is to provide a means to carefully lift a section of sidewalk, so the dirt underneath it can reworked to restore alignment. This procedure must not crack the sidewalk, or damage adjacent structures and landscaping. The device should be inexpensive, and practical for one-person operation.

These objectives are achieved in this invention. Multiple lift points distribute the force evenly to avoid cracking the lifted section. This device is much simpler and lighter than general-purpose heavy equipment, such as cranes, which would currently be required for this task. It is also much better suited, because it is specialized. It is light enough to be positioned manually using casters or wheels.

Repairs made with this device result in aligned, safe sidewalks, without the makeshift or mismatched appearance caused by the current repair methods. Labor, material, and equipment costs with this device are low, and consequential damage to adjacent surfaces is avoided.

There are two main advantages of the current invention over the previous Walklift-1:

1. In cases where the whole section is sunken, rather than just one end, Walklift-2 corrects the situation in one lift, whereas Walklift-1 requires two lifts and two positionings—correcting one end at a time. Thus, Walklift-2 is faster in those cases.

2. Walklift-1 requires more gap clearance between slabs, since the angle of a section lifted by one end can cause binding. Since Walklift-2 lifts the whole section vertically, there is no binding from that cause. Thus, Walklift-2 reduces the number of situations in which gap widening is required. However, there are cases where lifting from one end is better. The various cases, and the use of Walklift-2 to lift one or both ends, is described under "Operation".

DRAWING FIGURES

FIG. 1—Sidewalk lifter installed over a sunken section

Figure 2:
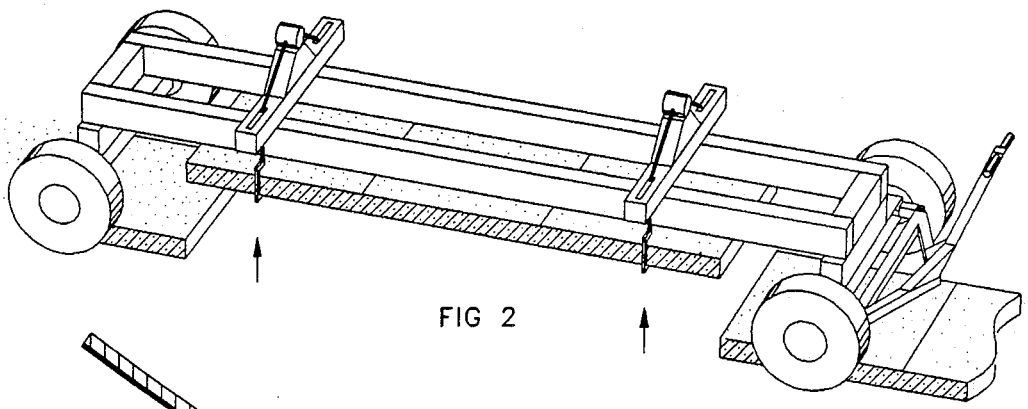

FIG. 2—Sidewalk lifted suspending liften section

Figure 3:
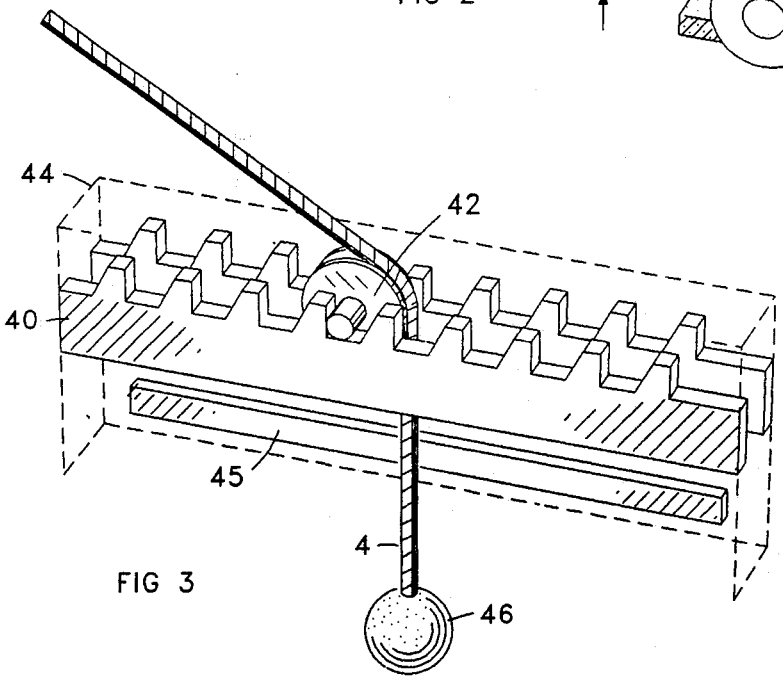

FIG. 3—Pulley adjustment device

Figure 4:
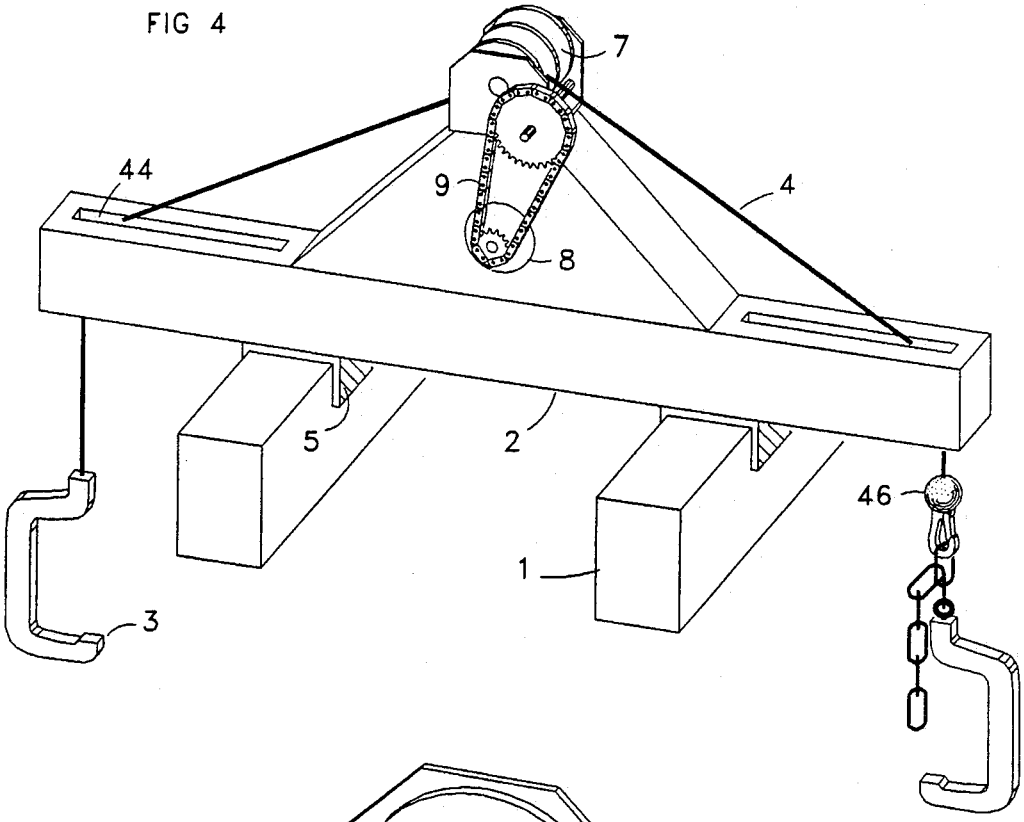

FIG. 4—Motorized winch with chain drive

Figure 5:
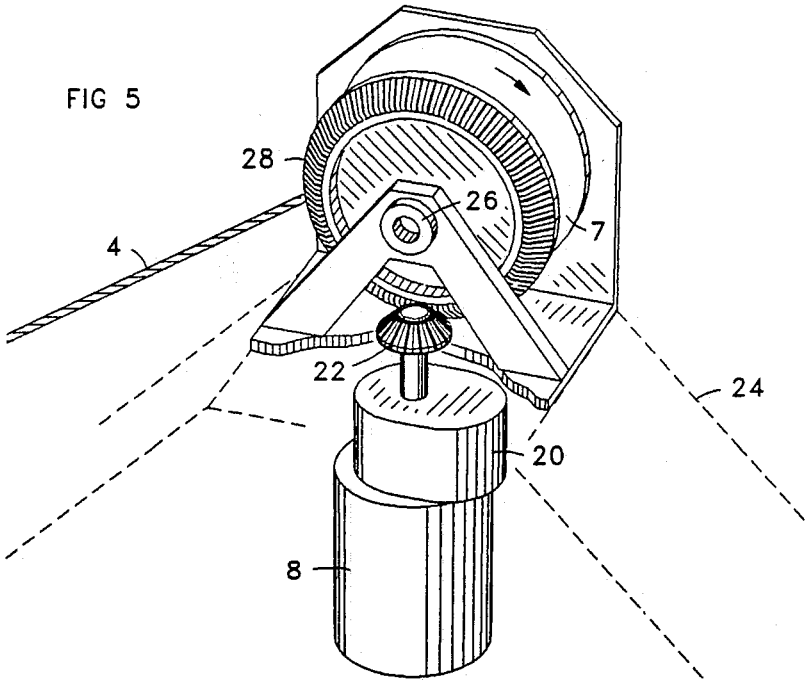

FIG. 5—Motorized winch with counter-rotating spools (one shown)

Figure 6:
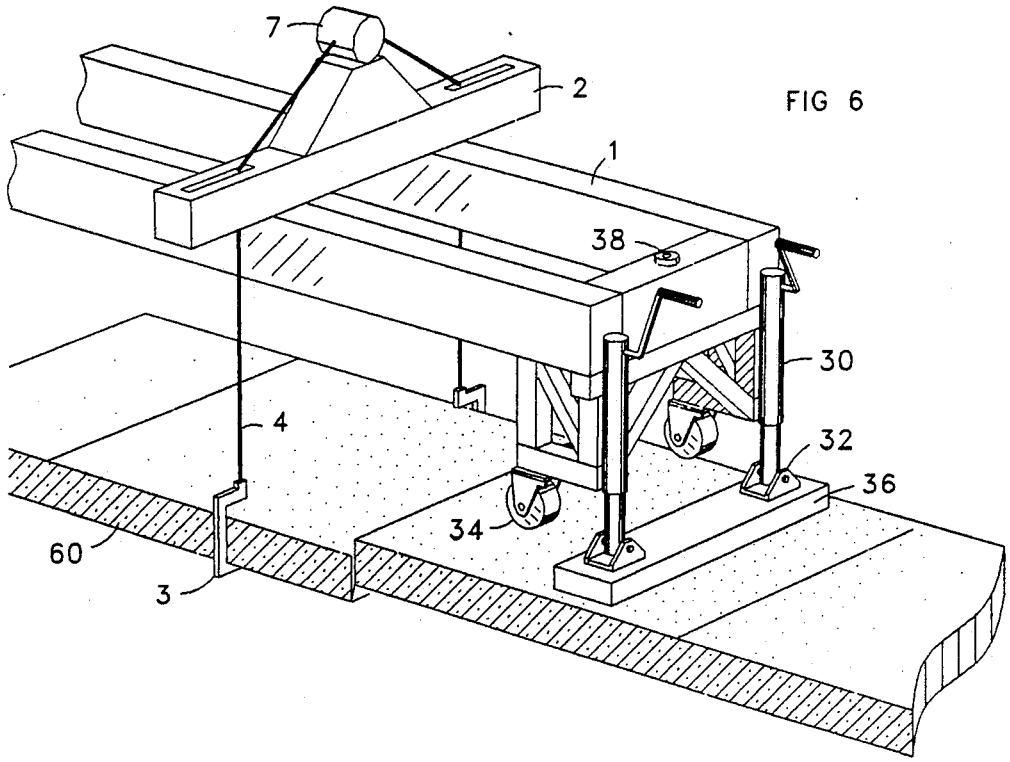

FIG. 6—Leveling jacks and casters

Figure 7:
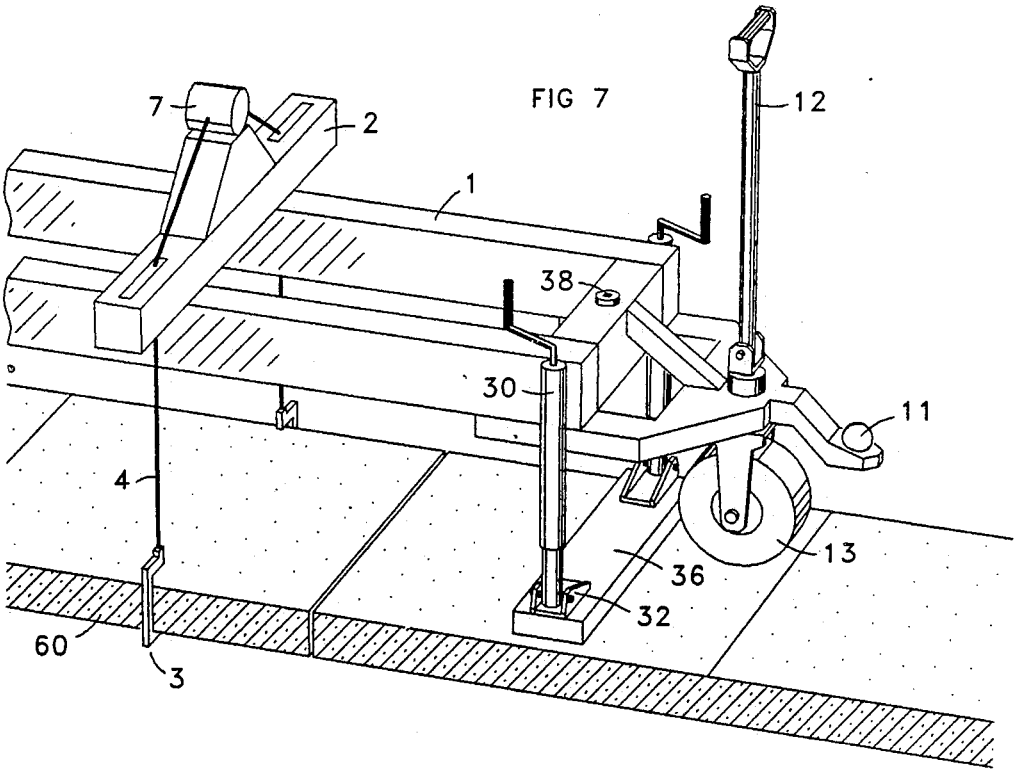

FIG. 7—Steerable front wheel and tow hitch

DRAWING REFERENCE NUMERALS:

1 Longitudinal span
2 Cross member
3 Lift hook
4 Suspension means
5 Sliding bracket
7 Which
8 Motor
9 Chain drive
10 Wheel
11 Tow hitch
12 Tow bar
13 Steerable front wheel
20 Gear box
22 Drive gear
24 Winch riser
26 Bearing sleeve for spool axle
28 Driven gear on spool
30 Leveling jack
32 Hinged jack base
34 Caster
36 Support pad
38 Level gauge
40 Toothed rail for pulley
42 Pulley
44 Pulley well
45 Limit switch
46 Suspension end marker for pushing limit switch
60 Concrete section to be lifted

DESCRIPTION

FIG. 1 is a general view of the device, comprising rigid longitudinal spans (1), supporting cross members (2). The cross members are movable along the longitudinal spans for positioning over desirable lifting points. The cross members should have sliding guides, such as the brackets (5) in FIG. 4, attached to their undersides to maintain lateral centering on the spans, while allowing longitudinal repositioning. Lock means is suggested, such as screws in the guides which clamp against the spans. One or more span members can be used—two are preferred. Two or more cross members can be used—two are preferred. A third cross member is useful in some cases, and as a spare. To simplify construction, one cross member can be immobile, with adjustment made by moving the other, mobile, member(s). However, this slightly reduces flexibility.

Hooks are suspended from the ends of the cross members to be hooked under the slab sides. The hooks are "C" shaped, or bracket shaped (see FIG. 4), to exert lift on the underside of the slab a short distance inward from its edge and directly below the hook-suspension point above the slab. This shape prevents slippage of the hooks around the edges of the slab. The described hook configuration provides evenly distributed lifting force, which is necessary to safely lift a slab without cracking it.

The hook suspension is drawn upward via a mechanical-advantage device, such as a winch, to lift the slab. This device can be manually operated, but a non-human power source is preferred. FIGS. 4 and 5 are examples of powered winches which pull two cables from opposite directions simultaneously. FIG. 4 shows a motor-driven winch with chain drive. Both sides of the partitioned spool rotate in the same direction. The cable exits from the top of one partition and from the bottom of the other. A better arrangement is shown in FIG. 5, in which bevel gearing provides counter-rotating spools. For clarity, only one of the two spools is shown. The second spool, which would be in the foreground in the figure, is a mirror image of the first, and contacts the drive gear (22) on its opposite side. This arrangement provides some stress cancellation for the winch attachment, and allows the maximum downward angle of the exiting cable from both spools.

The winches should be reversible, or controllably releasable, to allow smooth lowering of the lifted slab, and all winches should operate at the same rate, to maintain the level of the slab during suspension. They can be connected electrically to a switchboard on the device via flexible means, such as coil cords, which allows repositioning of the cross members. Each winch should be controllable independently, to allow lifting of only one side of a slab. However, concurrent operation of all winches should be convenient. This can be accomplished by mounting the controls immediately adjacent each other, for simultaneous manipulation, or a master control can be provided.

Although winches are preferred, other mechanical-advantage devices can be used. For example, the cross member itself can be lifted from the spans via jacks, or the spans can be lifted at their end points via jacks. In both cases, jacks with a long lift range are required, with low stability at the top of the lift. This requires more bracing and sturdy jacks with lateral force resistance. Thus, those designs impose weight, and are inherently less stable, but they are an option.

Level adjustment means, such as the leveling jacks shown in FIGS. 6 and 7, are advisable to insure direct vertical lift, stable support, and return of the slab to its starting point when lowered. FIG. 6 is a detailed view of an end of the device chassis. Casters are shown in this view, partly for clarity of the jacks, and partly to show the caster alternative. Full-sized wheels as in FIGS. 1 and 2 can also be used in combination with the leveling jacks. In either case, the jacks relieve support from the rolling means before lifting is done. Hinged jack bases (32) allow two jacks, mutually connected to a support pad (36), to have a range of angles between jack and pad due to lateral level adjustment. The pad distributes weight to avoid cracking the adjacent slab. Longitudinal adjustment is made via different average jack extensions at the two ends of the device. These jacks are used for leveling, not lifting. Thus their lifting capacity need only be for the device itself, while their static capacity must also support the slab. A 12-foot by 4-foot by 4-inch slab weighs about 1800 lbs. To allow for slab binding and a safety factor, a static capacity of at least 2000 lbs for each of the 4 leveling jacks is suggested. Other leveling means, such as jack stands, blocks, and the like can be used instead of, or in combination with, the convenient crank-type jacks shown.

A two-dimensional level gauge (38) attached to the chassis is useful to insure both lateral and longitudinal leveling. A one-dimensional level gauge, mounted on each cross beam, is suggested, for verification of lateral level after the lift hooks are set and suspension slack is removed.

If leveling means is not provided, the device will lean and be less stable on tilted sidewalks, requiring more bracing to resist lateral stress on the support legs, requiring trussing of the longitudinal spans to prevent lateral bowing, and requiring asymmetric lateral positioning of the cross members or asymmetric lateral adjustment of the suspension means to achieve vertical lift. The inventor believes these disadvantages and costs are greater than the cost of providing leveling means. In any case, adjustment of the device for direct vertical lift is needed so that the slab returns to its starting point upon lowering.

Leveling jacks could be designed to serve double duty as lifting jacks. This requires a long lifting range on the jacks, coordination of the lift rate among all 4 jacks, uncoupling of this coordination for leveling, and much sturdier jacks, since the device chassis would be lifted approximately twice as high as with the winch embodiment. For these reasons, the winch embodiment is preferred.

After the device is leveled, the distance is different from each end of a cross member to the corresponding edge of a laterally tilted sidewalk. Therefore, the lift hook suspensions should have independent vertical adjustment means to compensate. For example, a short length of chain can be attached to a hook as in FIG. 4, and the suspension can be attached to the chain at a selected link via a snap hook or the like. It is not necessary to allow the snap hook to pass through the pulley. Instead, it should actuate an upper-limit switch (such as 45 in FIG. 3) at the pulley well, since the slab will be fully lifted when any snap hook reaches its well.

Only one of each pair of lift hooks requires vertical adjustment means if the level condition is at the middle of the adjustment. In operation, the non-adjustable hook is placed first, and suspension slack is eliminated by winch operation. Then the adjustable hook is placed, and its suspension slack is eliminated by its vertical adjustment. However, it is better if all suspensions have vertical adjusment means, since the upper suspension limit then always achieves the maximum lift of the workpiece. Each suspension should have a capacity of at least 1000 lbs, for a total of at least 4000 lbs.

A possible upper-limit switch design is shown in FIG. 3. Limit switches can be mounted in the lower pulley wells (44). The switch actuator can extend the length of the well and sense the end of the suspension. A flexible ball (46), spring, or the like, can be mounted on the suspension end to press the switch as it enters the well. There should be a switch in each well, so that the first suspension to reach its end stops the lift. This design protects the switches from harm by locating them in the wells, and allows slight continuance of motion after a switch is pressed. Enlargements on the suspension ends provide the added benefit of keeping the suspensions in place during transport if the lift hooks are not attached. Many other limit-switch arrangements could be devised besides this example.

Since sidewalks vary in width, the hook-suspension points on the cross members should be laterally adjustable. This can be done by means such as the adjustable pulley shown in FIG. 3. The pulley (42) can be placed at any of several braced positions on the toothed rails (40) to vary the suspension width. The pulley should be made captive to avoid its loss during transport. This can be done with a plate mounted horizontally above the rails at a distance barely admitting the pulley axle over the tooth tops. The plate can have a rectangular slot just wide enough for the pulley wheel, preventing passage of the pulley axle. The pulley wheel can be grasped by the thumb and finger through the slot to reposition it.

Wheels or casters should be provided to make positioning practical. Various examples are illustrated in FIGS. 1, 2, 5, and 6. Here "wheels" means rolling means large enough for rough and/or soft terrain, as distinguished from casters, which are smaller and only useful on hard flat surfaces. Attached wheels can be made suitable for road towing of the device, in which case a tow hitch can be provided at one end of the device chassis. If casters are used, the device is transported by truck or trailer. Casters should be the swivel type on one end of the device. A handling bar (12) is useful for manual positioning. If wheels are used, this bar should turn the one(s) at its end.

Wheels and casters each have advantages. Wheels can provide means for road towing, and allow the device to be easily moved over grass, soil, and rough surfaces. However, wheels suitable for road towing can get in the way once the device is in position. If the terrain rises sharply beside the sidewalk, a wide wheelbase will cause the device chassis to tilt. For this reason, it is suggested that road wheels be removable. The preferred configuration is a removable pair of road wheels toward the rear of the chassis, and a single front wheel, attached steerably to a manual tow handle as in FIG. 7. A tow hitch can be mounted so that the front wheel of the device is raised off the ground for road towing, allowing the front wheel to be simple and less expensive, not requiring springs.

The height of the device, when installed and leveled, should provide a lift clearance of at least 1 foot above the upper plane of the sidewalk. More than this is unnecessary for adding and spreading dirt. Long handled spreaders can easily work within a foot of clearance. This would make the nominal distance from the bottom of the support pad to the bottom of the longitudinal spans about 18 inches—12 inches lift clearance, plus 4–5 inches thickness of the lifted slab, plus 1 inch tolerance for the limit switches.

PREFERRED EMBODIMENT

A. Two longitudinal spans
B. Two cross members
C. 12-volt motor-powered winches as in FIG. 5
D. Steel cable suspension, terminating in hooks
E. Section of chain on each lifting hook for vertical adjustment
F. Adjustable pulleys as in FIG. 3
G. Limit switches as in FIG. 3
H. Crank operated leveling jacks as in FIG. 6 or 7
I. Removable rear road wheels
J. A single steerable front wheel and manual tow handle as in FIG. 7
K. A tow hitch located such that the front wheel is raised when the hitch is used

OPERATION

The device is positioned and leveled straddling the section to be lifted. It is centered both laterally and longitudinally over the section. If road wheels are in the way, they are removed prior to leveling, otherwise they are left attached. The leveling means provides solid support on the adjacent slabs, relieving the wheels or casters from the support function. Lift hooks are hooked under the edges of the section a short distance from the section ends (about 20% of the section's length is an optimum distance for the lift hooks from the ends of the section). On the highest side of the section, the suspension cables are attached directly to the lift hooks, and the winches are tightened to remove slack. On the low side, the suspension is attached to the vertical adjustment means, which is adjusted to remove slack. The cross members are now level, with no slack in the suspension cables. The winches are operated in unison to raise the slab to the lift limit, which is sensed by a limit switch, stopping the winches.

The dirt underneath the lifted slab is supplemented or reduced as needed, and graded manually, using a long handled spreader. The spreader may include an inclinometer in its handle to assist creating the desired grade. The winches are then operated in reverse, or controllably released, to lower the lifted section.

Preparation for this operation includes deep edging around the section to be lifted to avoid having sod slip under the section as it is lowered. Also, one or both gaps between the section to be lifted and its neighbors may have to be widened to prevent binding. This is likely with a crack, rather than an expansion joint. Widening can be done with a masonry saw, but this can often be avoided. There are more ways to avoid it with the current invention, Walklift-2, than with the previous Walklift-1. This is because the whole slab, or just one end, may be lifted with Walklift-2, and each technique has advantages depending on the circumstances.

In the case where only one end of a section is sunken or misaligned, the device may be used to lift only that end. This decision is based on the condition of the section joints. If both joints are smooth and wide, as with expansion joints, then either end or the whole slab can be lifted easily. If both joints are smooth but narrow, then vertical lifting of the whole slab is best, to avoid binding. If the misaligned end has a wide joint, and the other end is just cracked, it is best to lift only the misaligned end, to avoid the necessity of widening the crack.

Lifting of one end is best done using a high position of the leveling means on the lift end, and a low position on the other end. The device is leveled laterally only. This results in lifting force vectors close to parallel to the support legs, such as the leveling jacks, and perpendicular to the longitudinal spans. When lifting one end, only one cross member and winch are used. The other cross member should not be positioned in the middle of the slab for additional lift. If desired, the two cross members can be placed immediately adjacent each other near the lift end, and both used, but this is normally unnecessary.

If a section is tilted laterally, it can be leveled by leveling the dirt underneath it. To guide this, a long-handled dirt-spreading tool with an inclinometer in its handle would be useful. Perfect leveling is not always desirable, since adjacent sections may not be level. Spreading dirt to match the slope of an adjacent section can be done by eye, although a spreader with an inclinometer would be helpful, since it can be used to measure the slope of the adjacent section, and then reproduce that slope.

This invention can find use in several types of realignment situations. In the case of a section lifted by roots, the adjacent section can be raised to match. The roots should also be cut, and a root barrier installed, to prevent further damage. It is possible to lower a section by lifting it and removing dirt from beneath it. However, roots can make this more difficult than raising the adjacent section.

I claim:

1. A concrete slab lifting device, comprising:

an elongated, generally horizontal beam;

supports mounted on each end of the beam for upholding the device;

a plurality of crossbeams mounted atop said elongated beam;

at least one of said crossbeams longitudinally repositionable upon said elongated beam;

a pair of generally C-shaped hooks suspended from opposite ends of each crossbeam;

means for adjustably selecting a horizontal distance between said pair of hooks along each crossbeam; and winch means attached to each crossbeam for retracting said pair of hooks in unison, whereby objects of different widths may be lifted.

2. The device of claim 1, further including means connected to said supports for moving said device, a tow hitch mounted on the device, and a foldable manual tow bar mounted on the device.

3. The device of claim 1, further including a plurality of leveling jacks connected to said supports.

4. The device of claim 3, further including a level gauge mounted on an element of said device.

5. The device of claim 1, wherein said winch means operates a pair of counter-rotating spools.

6. A concrete slab lifting device, comprising:

a plurality of elongated beams, generally horizontal and parallel;

support means mounted on each end of the beams for upholding the device;

a plurality of crossbeams mounted atop said elongated beams;

at least one of said crossbeams longitudinally repositionable upon said elongated beams;

a pair of generally C-shaped hooks suspended from opposite ends of each crossbeam;

means for adjustably selecting a horizontal distance between said pair of hooks along each crossbeam; and winch means attached to each crossbeam for retracting said pair of hooks in unison, whereby objects of different widths may be lifted.

7. The device of claim 6, further including means connected to said support means for moving said device, a tow hitch mounted on the device, and a foldable manual tow bar mounted on the device.

8. The device of claim 6, further including a plurality of leveling jacks connected to said support means.

9. The device of claim 8, further including a level gauge mounted on an element of said device.

10. The device of claim 6, wherein said winch means operates a pair of counter-rotating spools.

* * * * *